US007651366B2

(12) United States Patent
Ringler et al.

(10) Patent No.: US 7,651,366 B2
(45) Date of Patent: Jan. 26, 2010

(54) ELECTRICAL CONNECTOR ASSEMBLY WITH SHORTING CONTACTS

(75) Inventors: Daniel Robert Ringler, Elizabethville, PA (US); Jeffrey George Pennypacker, Corning, NY (US); Attalee S. Taylor, Palmyra, PA (US); Steven Jay Millard, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/879,450

(22) Filed: Jul. 16, 2007

(65) Prior Publication Data

US 2009/0023332 A1 Jan. 22, 2009

(51) Int. Cl.
*H01R 31/08* (2006.01)

(52) U.S. Cl. ..... 439/513

(58) Field of Classification Search ..... 439/513, 439/152, 157, 160, 325, 328, 377, 637, 59–62, 439/188; 361/787
See application file for complete search history.

(56) References Cited

U.S. PATENT DOCUMENTS

| | | | | |
|---|---|---|---|---|
| 3,639,888 | A * | 2/1972 | Pittman et al. | 439/260 |
| 3,903,385 | A * | 9/1975 | Moyer et al. | 200/51.1 |
| 4,087,151 | A | 5/1978 | Robert et al. | |
| 4,418,475 | A | 12/1983 | Ammon et al. | |
| 5,575,687 | A | 11/1996 | Tsai | |
| 5,676,555 | A | 10/1997 | Yu et al. | |
| 5,913,700 | A | 6/1999 | Tobey et al. | |
| 6,149,467 | A | 11/2000 | Choy | |
| 6,358,061 | B1 | 3/2002 | Regnier | |
| 6,764,345 | B1 * | 7/2004 | Duesterhoeft et al. | 439/637 |

* cited by examiner

*Primary Examiner*—Edwin A. Leon

(57) ABSTRACT

An electrical connector assembly is provided. The electrical connector assembly includes a housing including a body fabricated at least partially from a dielectric material. The housing body has an opening therein. An electrical contact is held by the housing. The electrical contact includes an intermediate portion and a spring potion each held at least partially within the opening. The spring portion of the electrical contact is engaged by the housing body such that the spring portion is deflected into shorting engagement with the intermediate portion of the electrical contact.

20 Claims, 7 Drawing Sheets

ELECTRICAL CONNECTOR ASSEMBLY WITH SHORTING CONTACTS

BACKGROUND OF THE INVENTION

The invention relates generally to electrical connectors, and, more particularly, to socket connectors for retaining electronic modules.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), or the newer Dual In-line Memory Modules (DIMM's), Small Outline DIMM's (SODIMM's) and Fully Buffered DIMM's. Typically, the electronic modules are installed in one or more multi-pin sockets mounted on a system board or motherboard. Each electronic module has a card edge that provides an interface generally between two opposite rows of contacts in the socket.

There is an ongoing trend toward smaller electronic packages. This trend is accelerated by the adoption of certain standards such as the Advanced Telecommunications Computing Architecture (ATCA) standard. In systems that adhere to the ATCA standard, the space provided for electronic modules and socket connectors is limited. Space limitations require that the size of the electronic modules as well as the socket connectors be reduced. At least some known socket connectors include electrical contacts having a vertical contact design. However, such vertical electrical contacts may not provide a socket connector with as low of a vertical profile as desired. A conventional shepherd's hook beam contact may enable a lower vertical profile. However, shepherd's hook beam contacts may have too long of an electrical path length.

There is a need for a lower profile socket connector that may be used in space-limited applications.

BRIEF DESCRIPTION OF THE INVENTION

In one embodiment, an electrical connector assembly is provided. The electrical connector assembly includes a housing including a body fabricated at least partially from a dielectric material. The housing body has an opening therein. An electrical contact is held by the housing. The electrical contact includes an intermediate portion and a spring portion each held at least partially within the opening. The spring portion of the electrical contact is engaged by the housing body such that the spring portion is deflected into shorting engagement with the intermediate portion of the electrical contact.

Optionally, the housing body may include a shoulder. The opening communicates with the shoulder. The spring portion of the electrical contact includes an extension that engages the shoulder such that the spring portion is deflected into shorting engagement with the intermediate portion of the electrical contact.

Optionally, the intermediate portion of the electrical contact extends between mating and mounting contact portions of the electrical contact. The mating contact portion is configured to electrically connect to a first electrical component and the mounting contact portion is configured to electrically connect to a second electrical component.

Optionally, the intermediate portion of the electrical contact comprises an extension that engages the housing body to facilitate preventing and/or reducing movement of the intermediate portion when the spring portion is deflected into shorting engagement with the intermediate portion.

In another embodiment, a socket connector assembly is provided for connecting a module card to a circuit board. The socket connector assembly includes a housing extending along a longitudinal axis between opposite ends. The housing includes a mounting face configured for mounting on the circuit board and a slot configured to receive a mating edge of the module card. The housing body has a plurality of openings therein. A plurality of electrical contacts are held by the housing. Each electrical contact includes an intermediate portion and a spring portion each held at least partially within the corresponding opening. The spring portion of each of the electrical contacts is engaged by the housing body such that the spring portion is deflected into shorting engagement with the intermediate portion of the same electrical contact.

In another embodiment, a socket connector assembly is provided for connecting a module card to a circuit board. The socket connector includes a housing extending along a longitudinal axis between opposite ends. The housing includes a mounting face configured for mounting on the circuit board and a slot configured to receive a mating edge of the module card. The housing body has an opening therein. An electrical contact is held by the housing. The electrical contact includes an intermediate portion and a spring portion each held at least partially within the opening. The spring portion of the electrical contact is in shorting engagement with the intermediate portion of the electrical contact before the mating edge of the module card is inserted within the slot.

DETAILED DESCRIPTION OF THE INVENTION

Figure 1:
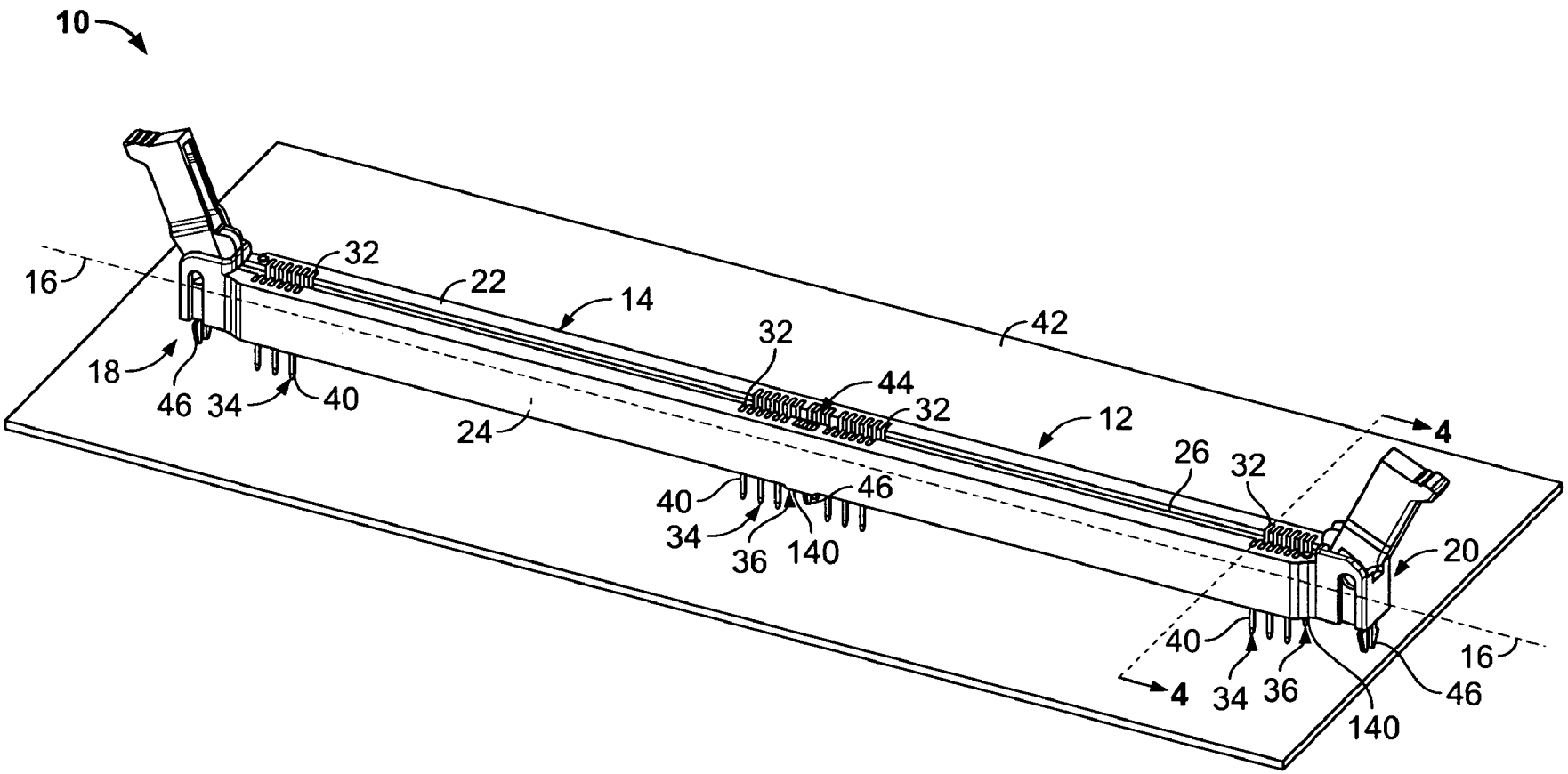
FIG. 1 is a perspective view of an exemplary embodiment of a socket connector assembly.
Figure 2:
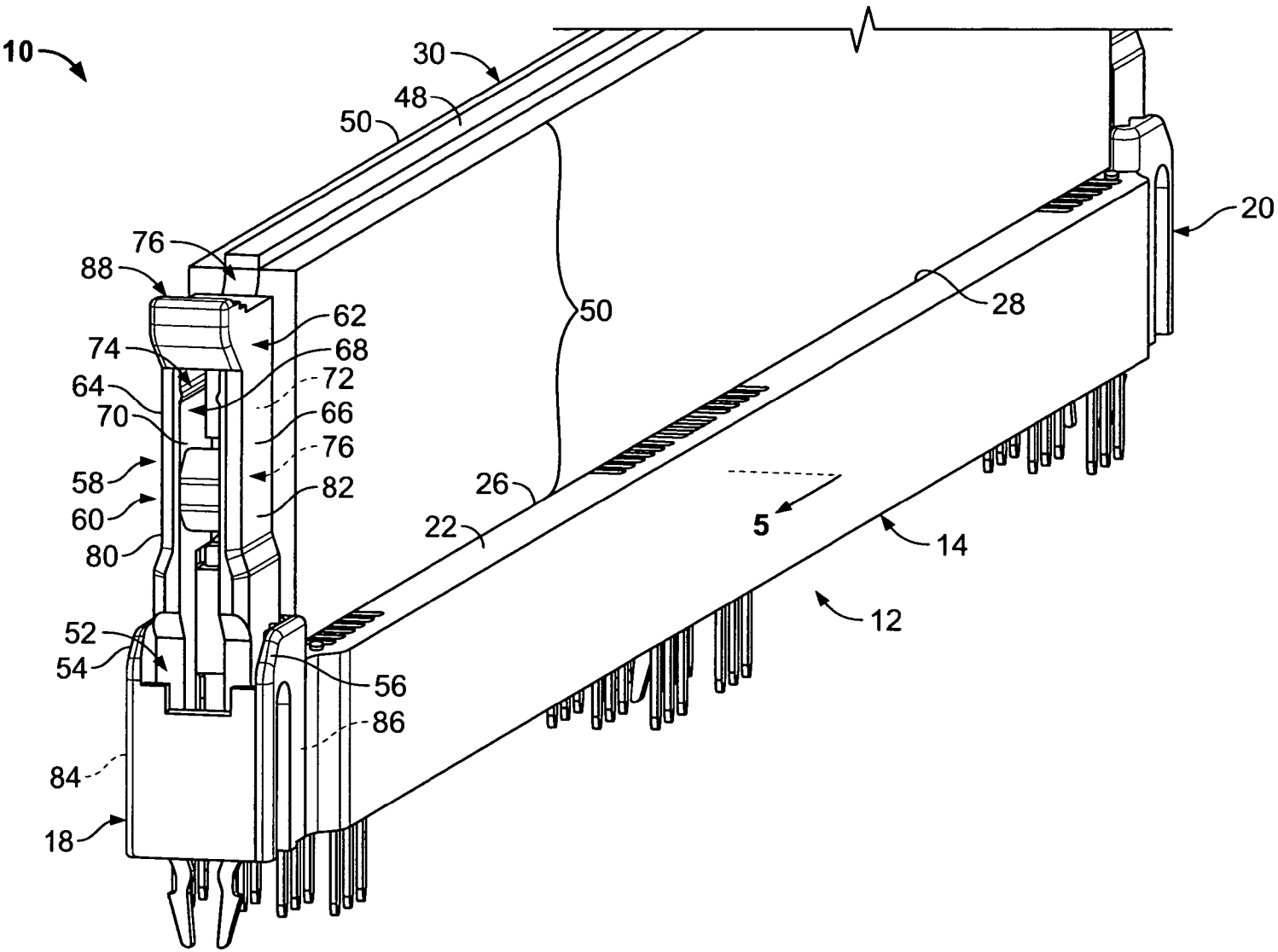
FIG. 2 is a partial perspective view of the socket connector assembly shown in FIG. 1 with an exemplary electronic module installed thereon.

FIG. 1 is a perspective view of an exemplary embodiment of a socket connector assembly 10. The socket connector assembly 10 includes a housing 12 having a dielectric body 14 that extends along a central longitudinal axis 16 between opposite end portions 18 and 20. The body 14 has a mating face 22 and a mounting face 24. The body 14 includes a slot 26 that is configured to receive a mating edge portion 28 (FIG. 2) of an electronic module 30 (FIG. 2). The housing body 14 includes a plurality of openings 32 that each communicate with the slot 26 and extend through the housing body 14 from the mating face 22 to the mounting face 24. As will be described in more detail below, each opening 32 holds a portion of a corresponding inner or outer electrical contact 34 and 36, respectively, therein. Each inner and outer electrical contact 34 and 36, respectively, includes a respective mating contact, portion 38 and 138 (FIG. 3) and a respective mounting contact portion 40 and 140. The mating contact portions 38 and 138 extend into the slot 26 to electrically engage contact pads (not shown) on the electronic module 30 when the electronic module 30 is installed in the socket connector assembly 10. The mounting contact portions 40 and 140 extend from the mounting face 24 of the housing body 14 and are configured to electrically connect the socket connector assembly 10 to a circuit board 42 to enable the connection of the electronic module 30 to the circuit board 42. The inner and outer electrical contacts 34 and 36, respectively, are alternated within adjacent openings 32 to form inner rows 39 and 41 (FIGS. 5 and 6) of the mounting contact portions 40 and outer rows 43 and 45 (FIGS. 5 and 6) of the mounting contact portions 140. Specifically, the mounting contact portions 40 of the inner electrical contacts 34 are arranged in a pair of opposite inner rows 39 and 41 that are offset on opposite sides of the central longitudinal axis 16 of the housing body 14. Similarly, the mounting contact portions 140 of the outer electrical contacts 36 are arranged in a pair of opposite outer rows 43 and 45 that are offset on opposite sides of the central longitudinal axis 16 of the housing body 14 by a greater amount than the inner rows 39 and 41.

Optionally, a key 44 may be provided at an off-center position in the slot 26 for reception within a notch (not shown) in the electronic module 30 to assure that the electronic module 30 is properly aligned with respect to the connector assembly 10. One or more board locks 46 may optionally be provided to mechanically attach the socket connector assembly 10 to the circuit board 42.

As will be described in more detail below, each of the inner and outer electrical contacts 34 and 36, respectively, is engaged by the housing body 14 such that each of the electrical contacts 34 and 36 electrically shorts against itself. Each of the inner and outer electrical contacts 34 and 36, respectively, are considered to be "pre-shorted" because each of the electrical contacts 34 and 36 electrically shorts against itself, via engagement with the housing body 14, before insertion of the mating edge portion 28 of the electronic module 30 into the slot 26. In other words, each of the electrical contacts 34 and 36 electrically shorts against itself independent of the electronic module 30.

FIG. 2 is a perspective view of the socket connector assembly 10 with an exemplary electronic module 30 installed thereon. The electronic module 30 includes a planar substrate 48 that has the mating edge portion 28 and a plurality of electrical traces (not shown), each of which terminates at a respective contact pad (not shown) on the mating edge portion 28. When the electronic module 30 is installed on the housing body 14 as shown in FIG. 2, each of the contact pads on the mating edge portion 28 of the electronic module 30 electrically engages the mating contact portion 38 or 138 (FIGS. 5 and 6) of a corresponding one of the electrical contacts 34 or 36. The substrate 48 includes exemplary surface mounted components generally represented at 50.

The housing end portions 18 and 20 are substantially identical and therefore only the housing end portion 18 is described in detail. The housing end portion 18 includes a cavity 52 between opposed towers 54 and 56 that extend outwardly at the mating face 22 of the housing body 14. An extractor 58 is received in the cavity 52. The extractor 58 is pivotably connected to the housing end portion 18 for retaining the electronic module 30 on the housing body 14 and for extracting the electronic module 30 from the housing body 14. Specifically, the extractor 58 extends outwardly between the towers 54 and 56 and is pivotable between an open position (FIG. 1) for receiving the electronic module 30 within the slot 26 and a closed position (FIG. 2) for retaining the electronic module 30.

The extractor 58 includes a pair of opposite side portions 60 and 62 that each engages the electronic module 30. Specifically, each of the side portions 60 and 62 includes a side wall 64 and 66, respectively. The side walls 64 and 66 are spaced apart from one another such that an extractor slot 68 is defined therebetween. The extractor slot 68 is in communication with the slot 26 in the housing body 14. The extractor slot 68 receives the mating edge portion 28 of the substrate 48 of the electronic module 30. Opposite interior surfaces 70 and 72 of the side walls 64 and 66, respectively, include ribs 74 that engage an edge portion 76 of the substrate 48 of the electronic module 30 to stabilize the electronic module 30. Optionally, a beveled forward edge (not shown) on the ribs 74 provides guidance for facilitating entry of the edge portion 76 of the electronic module 30 into the extractor slot 68. The extractor 58 may include a latch element (not shown) that engages a notch (not shown) in the edge portion 76 of the substrate 48 of the electronic module 30 to facilitate retaining the electronic module 30 on the housing body 14. Opposite outer surfaces 80 and 82 of the side walls 64 and 66, respectively, may include a projection (not shown) that communicates with a retention receptacle (not shown) on inner surfaces 84 and 86 of the towers 54 and 56, respectively, to facilitate holding the extractor 58 in the closed position. A foot (not shown) of the extractor 58 engages a lower edge 87 (FIG. 5) of the mating edge portion 28 of the electronic module 30 to lift the electronic module 30 upward when the extractor 58 is opened to assist in the extraction of the electronic module 30 from the housing body 14. The extractor 58 may optionally include a thumb pad 88 for moving the extractor 58 between the open and closed positions.

Figure 3:
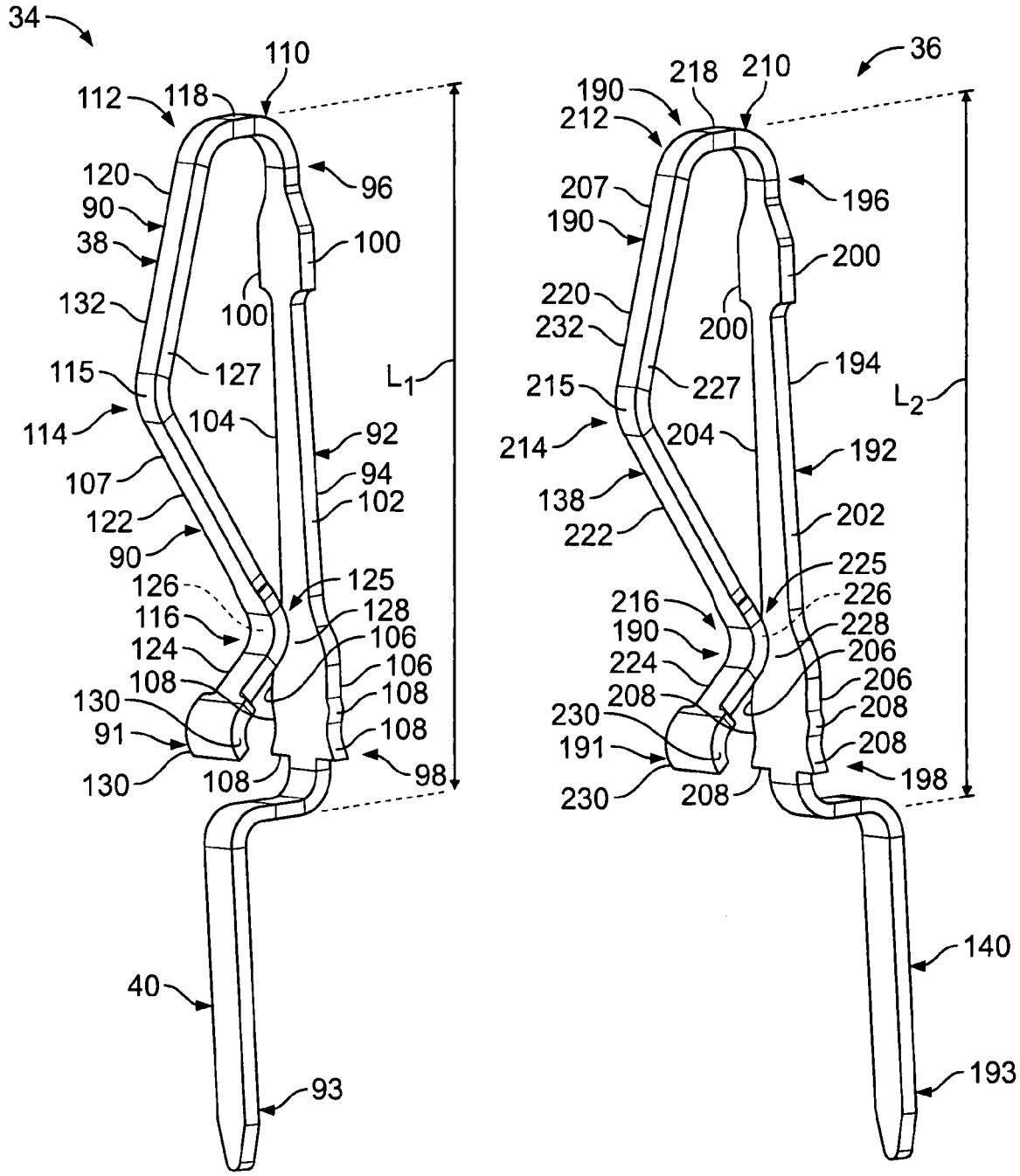
FIG. 3 is a perspective view of an exemplary embodiment of an inner electrical contact and an exemplary embodiment of an outer electrical contact of the socket connector assembly shown in FIG. 1.

FIG. 3 is a perspective view of an exemplary embodiment of an inner electrical contact 34 and an exemplary embodiment of an outer electrical contact 36 of the socket connector assembly 10 (FIGS. 1 and 2). Each inner electrical contact 34 includes the mating contact portion 38, the mounting contact portion 40, a spring portion 90, and an intermediate portion 92. Similarly, each outer electrical contact 36 includes the mating contact portion 138, the mounting contact portion 140, a spring portion 190, and an intermediate portion 192. In the exemplary embodiment, the spring portions 90 and 190 each include a respective end portion 91 and 191 of the respective inner and outer electrical contacts 34 and 36, and the mounting contact portions 40 and 140 each include a respective opposite end portion 93 and 193 of the inner and outer electrical contacts 34 and 36, respectively. Moreover, the spring portions 90 and 190 each include the respective mating contact portions 38 and 138. The intermediate portion 92 of the inner electrical contact 34 extends between the spring and mounting contact portions 90 and 40, respectively. Similarly, the intermediate portion 192 of the outer electrical contact 36 extends between the spring and mounting contact portions 190 and 140, respectively. The mounting contact portion 40 of the inner electrical contact 34 is offset from the intermediate portion 92 in a direction generally towards the spring portion 90. In contrast, the mounting contact portion 140 of the outer electrical contact 36 is offset from the intermediate portion 192 in a direction generally away from the spring portion 190. The exemplary geometry of the inner and outer electrical contacts 34 and 36, respectively, results in approximately equal electrical path lengths between the mounting contact portions 40 and 140.

The intermediate portion 92 of the inner electrical contact 34 includes a stem 94 extending a length $L_1$ between a pair of opposite end portions 96 and 98. In the exemplary embodiment, a pair of extensions 100 extend outwardly from opposite side surfaces 102 and 104 of the stem 94 adjacent the end portion 96. The extensions 100 are "paired" in that the extensions 100 extend from the opposite side surfaces 102 and 104 at approximately the same location along the length $L_1$ of the stem 94. Similarly, the intermediate portion 192 of the outer electrical contact 36 includes a stem 194 extending a length $L_2$ between a pair of opposite end portions 196 and 198. A pair of extensions 200 extends outwardly from opposite side surfaces 202 and 204 of the stem 194 adjacent the end portion 196. As will be described in more detail below, the extensions 100 and 200 are configured to engage the housing body 14 to facilitate preventing and/or reducing movement of the intermediate portions 92 and 192 within the corresponding opening 32 (FIGS. 1 and 2) of the housing body 14.

The intermediate portion 92 also includes a pair of extensions 106 that extend outwardly from the opposite side surfaces 102 and 104 of the stem 94 adjacent the end portion 98. Similarly, the intermediate portion 192 includes a pair of extensions 206 that extend outwardly from the opposite side surfaces 202 and 204 of the stem 194 adjacent the end portion 198. As will be described in more detail below, the extensions 106 and 206 are configured to engage the housing body 14 to facilitate retaining the inner electrical contact 34 in position within the corresponding opening 32 of the housing body 14 using an interference-fit arrangement. Optionally, each of the extensions 106 and 206 includes a plurality of respective projections 108 and 208 that engage the housing body 14.

The spring portion 90 of the inner electrical contact 34 includes a stem 107 that extends from the end portion 96 of the stem 94 of the intermediate portion 92. The stem 107 extends from the end portion 96 to the end portion 91 of the inner electrical contact 34. The stem 107 includes a plurality of joints 110, 112, 114, and 116 that define a plurality of arms 118, 120, 122, and 124, respectively. The arm 118 extends from the end portion 96 of the intermediate portion 92, while the arm 124 includes the end portion 91 of the inner electrical contact 34. The joint 114 and adjacent portions of the arms 120 and 122 define the mating contact portion 38. The contact pads (not shown) of the electronic module 30 (FIG. 2) engage a surface 115 of the stem 107 at the joint 114 when the electronic module 30 is installed on the housing body 14 (FIGS. 1 and 2). Similarly, the spring portion 190 of the outer electrical contact 36 includes a stem 207 that extends from the end portion 196 of the stem 194 of the intermediate portion 192. The stem 207 extends from the end portion 196 to the end portion 191 of the outer electrical contact 36. The stem 207 includes a plurality of joints 210, 212, 214, and 216 that define a plurality of arms 218, 220, 222, and 224, respectively. The arm 218 extends from the end portion 196 of the intermediate portion 192, while the arm 224 includes the end portion 191 of the outer electrical contact 36. The joint 214 and adjacent portions of the arms 220 and 222 define the mating contact portion 138. The contact pads of the electronic module 30 engage a surface 215 of the stem 207 at the joint 214 when the electronic module 30 is installed on the housing body 14.

Figure 5:
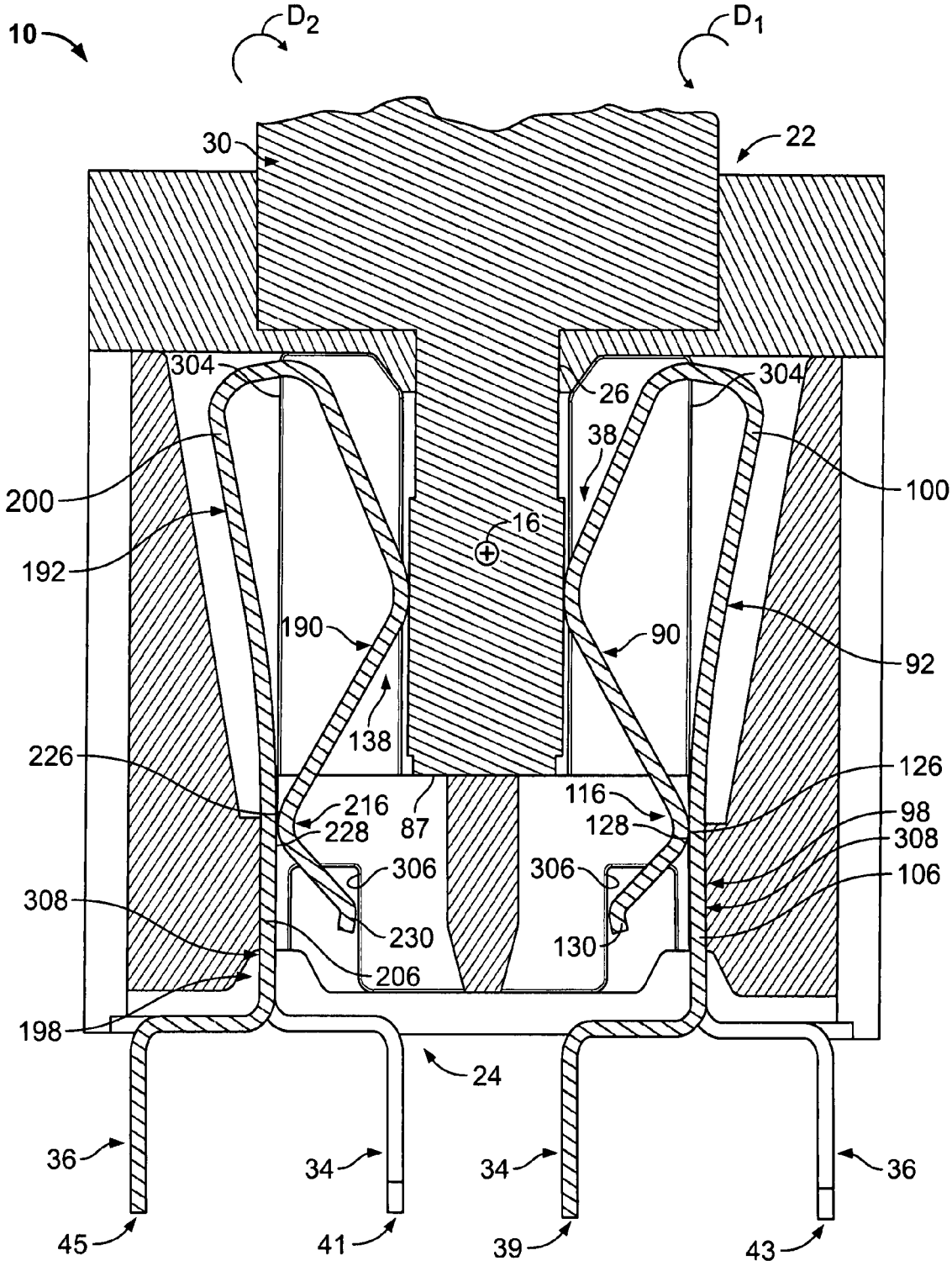
FIG. 5 is a cross-sectional view of the socket connector assembly shown in FIG. 2 taken along line 5-5 of FIG. 2.
Figure 6:
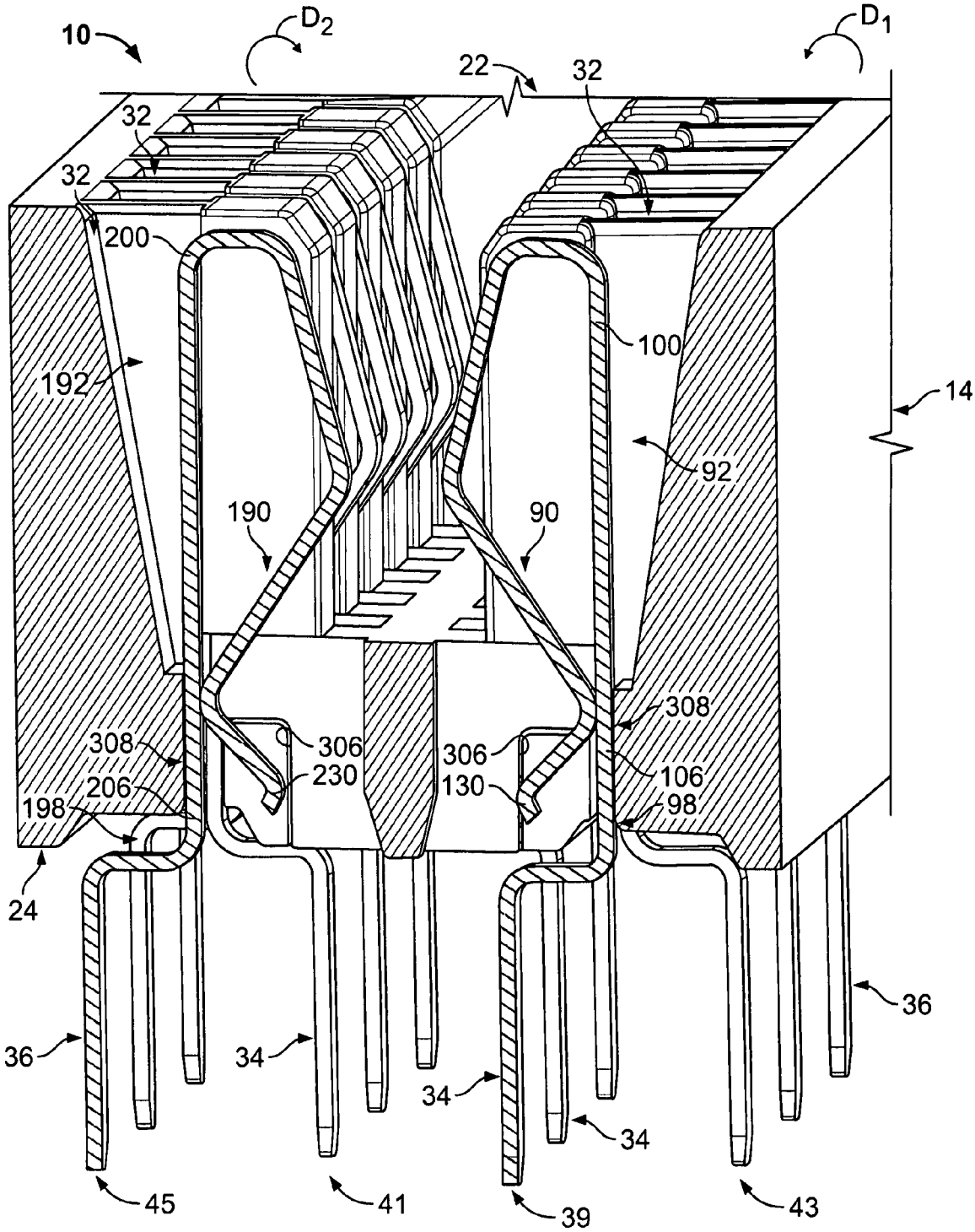
FIG. 6 is a perspective view of the cross section illustrated in FIG. 5 with the electronic module removed.

When the inner electrical contact 34 is not held by the housing body 14, the spring portion 90 is in a non-shorting position (FIG. 3) wherein a gap 125 is defined between a surface 126 of the stem 107 at the joint 116 and a surface 128 of the stem 94 of the intermediate portion 92. Similarly, when the outer electrical contact 36 is not held by the housing body 14, the spring portion 190 is in a non-shorting position (FIG. 3) wherein a gap 225 is defined between a surface 226 of the stem 207 at the joint 216 and a surface 228 of the stem 194 of the intermediate portion 192. The spring portions 90 and 190 are each configured to bend along at least a portion of the respective stem 107 and 208 such that the spring portions 90 and 190 move from the non-shorting position to a shorting position (FIGS. 5 and 6). With respect to the inner electrical contact 34, in the shorting position the surface 126 of the stem 107 at the joint 116 engages the surface 128 of the stem 94 of the intermediate portion 92. Similarly, with respect to the outer electrical contact 36, in the shorting position the surface 226 of the stem 207 at the joint 216 engages the surface 228 of the stem 194 of the intermediate portion 192.

In the exemplary embodiment, the inner electrical contact 34 includes a pair of extensions 130 that extend outwardly from opposite side surfaces 127 and 132 of the stem 107 at the arm 124. Similarly, the outer electrical contact 36 includes a pair of extensions 230 that extend outwardly from opposite side surfaces 227 and 232 of the stem 207 at the arm 224. As will be described in more detail below, the extensions 130 and 230 are configured to engage the housing body 14 to move the respective spring portions 90 and 190 from the non-shorting position to the shorting position and to retain the respective spring portions 90 and 190 in the shorting position.

In the exemplary embodiment, the spring portions 90 and 190 generally bend at the respective joints 110 and 112 and 210 and 212 to move from the non-shorting position to the shorting position. However, the spring portions 90 and 190 may bend along any portion(s) of the length of the respective stem 107 and 208 that enables the spring portions 90 and 190 to move from the non-shorting position to the shorting position. Moreover, although the surface 126 of the stem 107 engages the surface 128 of the stem 94 of the intermediate portion 92 at the joint 116, the spring portion 90 may engage any portion of the inner electrical contact 34 at any location along the stem 107 of the spring portion 90. Similarly, although the surface 226 of the stem 207 engages the surface 228 of the stem 194 of the intermediate portion 192 at the joint 216, the spring portion 190 may engage any portion of the outer electrical contact 36 at any location along the stem 207 of the spring portion 190.

Although one pair of two of the extensions 100, the extensions 106, the extensions 200, the extensions 206, the extensions 130, and the extensions 230 are shown, the respective portions 92, 192, 90, and 190 may each include any number of pairs of the respective extensions 100, 106, 200, 206, 130, and 230, and any number of the respective extensions 100, 106, 200, 206, 130, and 230 overall, that enable the extension(s) 100, 106, 200, 206, 130, and 230 to function as described and illustrated herein. In some embodiments, some or all of the extensions 100, 106, 200, 206, 130, and/or 230 are not paired with another respective extension 100, 106, 200, 206, 130, and 230 on the opposite side surface 102 or 104, 202 or 204, 127 or 132, and 227 or 232, respectively. Moreover, each extension 100, 106, 200, and 206 may extend from either of the side surfaces 102 or 104 and 202 or 204, respectively, and may be located at any portion of the respective length $L_1$ and $L_2$ of the respective stem 94 and 194 (whether or not the extension 100, 106, 200, and/or 206 is paired with another extension 100, 106, 200, and 206, respectively, on the respective opposite side surface 102 or 104 and 202 or 204). Similarly, each extension 130 and 230 may extend from either of the side surfaces 127 or 132 and 227 or 232, respectively, and may be located at any portion of the length of the respective stem 107 and 208 at any of the arms 118, 120, 122, 124, 218, 220, 222, and/or 224, respectively (whether or not the extension 130 and/or 230 is paired with another extension 130 and 230, respectively, on the respective opposite side surface 127 or 132 and 227 or 232).

The size, shape, and location on the electrical contacts 34 and 36 of each of the respective portions 38, 40, 90, 92, 138, 140, 190, and 192, as well as the overall size and geometry of the electrical contacts 34 and 36 overall, is not limited to the embodiments described and illustrated herein, but rather may be any suitable size, shape, location, and/or geometry that enables the electrical contacts 34 and 36 to be engaged by the housing body 14 such that each of the electrical contacts 34 and 36 electrically shorts against itself.

Figure 4:
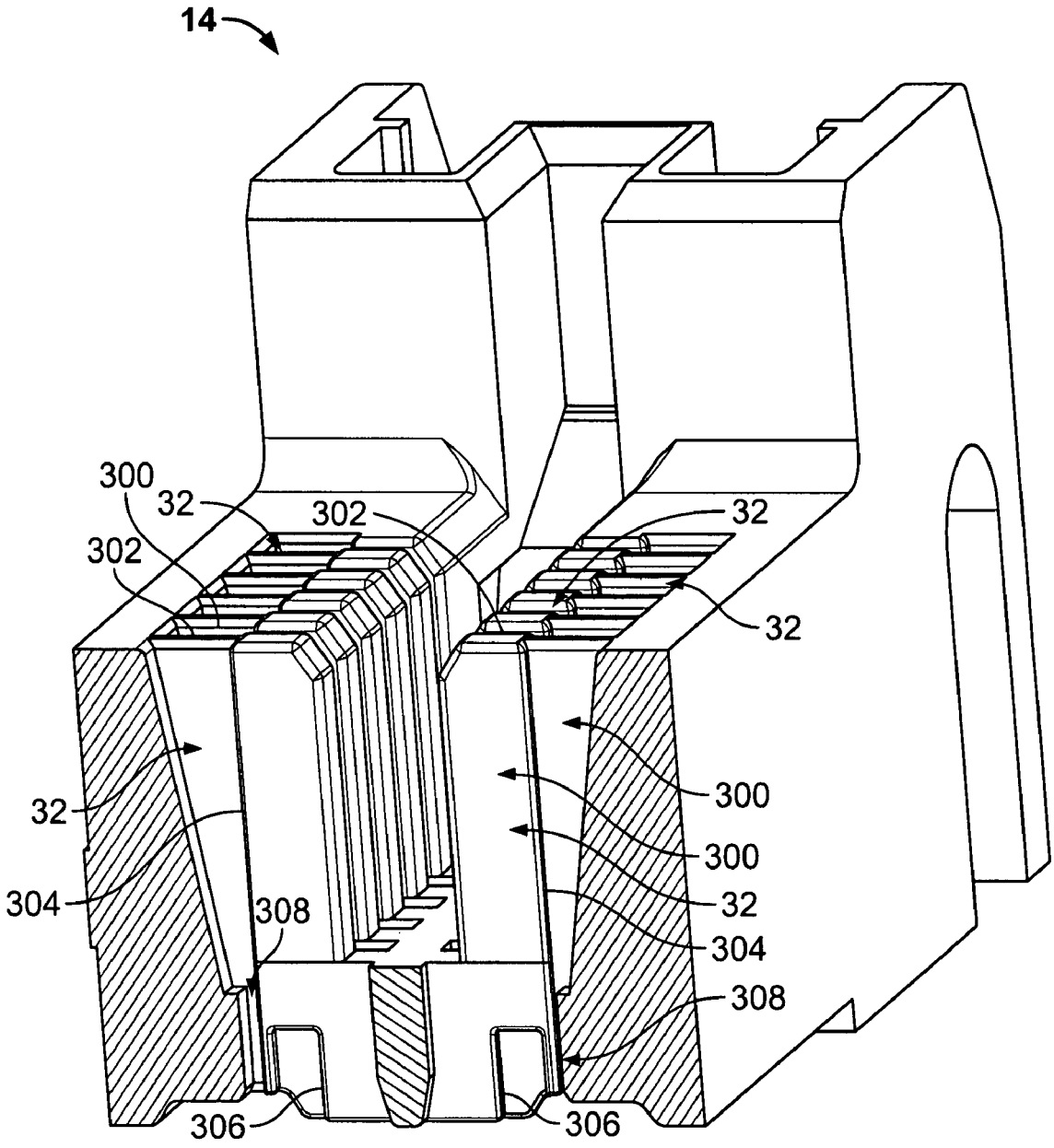
FIG. 4 is a perspective view illustrating a cross section of an exemplary embodiment of a housing of the socket connector assembly shown in FIG. 1 taken along line 4-4 of FIG. 1.

FIG. 4 is a perspective view illustrating a cross section of the housing body 14 of the socket connector assembly 10 taken along line 4-4 of FIG. 1. The housing body 14 is illustrated in FIG. 4 with the inner and outer electrical contacts 34 and 36 (FIG. 3), respectively, removed therefrom. The extractor 58 (FIGS. 1 and 2) has also been removed from the housing body 14 in FIG. 4. Each of the openings 32 within the housing body 14 includes a pair of opposite side walls 300 and 302, which may engage any of the side surfaces of the corresponding electrical contact 34 or 36 held therein. Each of the opposite side walls 300 and 302 includes a shoulder 304 formed therein. As will be described in more detail below, the shoulders 304 are configured to engage a corresponding one of the pair of extensions 100 or 200 (FIG. 3) of the corresponding electrical contact 34 or 36 to facilitate preventing and/or reducing movement of the corresponding intermediate portion 92 or 192 (FIG. 3).

Each of the opposite side walls 300 and 302 also includes a shoulder 306 formed therein. As will be described in more detail below, the shoulders 306 are configured to engage a corresponding one of the pair of extensions 130 or 230 (FIG. 3) of the corresponding electrical contact 34 or 36 to move the corresponding spring portion 90 or 190 (FIG. 3) from the non-shorting position to the shorting position and to retain the corresponding spring portion 90 or 190 in the shorting position. The side walls 300 and 302 also include a recess 308 formed therein. The recesses 308 are each configured to receive a corresponding one of the end portions 98 or 198 (FIG. 3) of the intermediate portions 92 or 192 (FIG. 3) of the corresponding electrical contact 34 or 36 (FIGS. 1-3). A corresponding one of the pair of extensions 106 or 206 (FIG. 3) engages the side walls 300 and 302 to facilitate retaining the corresponding electrical contact 34 or 36 in position within the opening 32 using an interference-fit arrangement. Optionally, the projections 108 or 208 (FIG. 3) of the corresponding extension 106 or 206 may engage the side walls 300 and 302 to facilitate retaining the corresponding electrical contact 34 or 36 using an interference-fit arrangement.

Although the exemplary embodiment includes two, each side wall 300 and 302 of each opening 32 may include any number of recesses 308 for cooperating with any number of extensions 106 or 206 on the corresponding intermediate portion 92 or 192. Each recess 308 may include any suitable shape, and may have any suitable location on the corresponding side wall 300 or 302, that enables the recess 308 to cooperate with the corresponding extension 106 or 206 to facilitate retaining the corresponding electrical contact 34 or 36 as described and illustrated herein. Moreover, although each opening 32 includes two shoulders 304 and two shoulders 306 in the exemplary embodiment, each side wall 300 and 302 of each opening 32 may include any number of shoulders 304 and any number of shoulders 306 for cooperating with any number of respective extensions 100 or 200 and 130 or 230. Although the shoulders 304 are each shown as having a generally planar surface, each shoulder 304 may include any suitable shape, and may have any suitable location on the corresponding side wall 300 or 302, that enables the shoulder 304 to cooperate with the corresponding extension 100 or 200 to facilitate preventing and/or reducing movement of the respective intermediate portion 92 or 192 as described and illustrated herein. Similarly, each shoulder 306 may include any suitable shape, and may have any suitable location on the corresponding side wall 300 or 302, that enables the shoulder 306 to cooperate with the corresponding extension 130 or 230 to move the corresponding spring portion 90 or 190 as described and illustrated herein.

FIG. 5 is a cross-sectional view of the socket connector assembly 10 taken along line 5-5 of FIG. 2. FIG. 6 is a perspective view of the cross section of FIG. 5 with the electronic module 30 removed from the slot 26. The housing body 14 is illustrated in FIGS. 5 and 6 with the inner and outer electrical contacts 34 and 36, respectively, positioned within the corresponding openings 32. As each electrical contact 34 and 36 is inserted within the corresponding opening 32 (from the mounting face 24, and before the electronic module 30 is inserted within the slot 26), the spring portion 90 or 190 is deflected into shorting engagement with the intermediate portion 92 or 192 of the same electrical contact 34 or 36. Specifically, each of the extensions 130 or 230 of the electrical contact 34 or 36 is engaged by the corresponding shoulder 306 such that the spring portion 90 or 190 moves from the non-shorting position (FIG. 3) to the shorting position wherein the surface 126 or 226 (FIG. 3) of the joint 116 or 216 engages the surface 128 or 228 (FIG. 3) of the intermediate portion 92 or 192. As the spring portion 90 or 190 is deflected, the extensions 100 or 200 of the electrical contact 34 or 36 are engaged by the corresponding shoulder 304 to facilitate preventing and/or reducing movement of the corresponding intermediate portion 92 or 192. Specifically, the shoulder 304 facilitates preventing and/or reducing rotational movement in the direction $D_1$ or $D_2$ of the intermediate portion 92 or 192, respectively, caused by the deflection of the spring portion 90 or 190 toward the intermediate portion 92 or 192. As can be seen from FIG. 5, once the electronic module 30 is inserted within the slot 26, engagement between the contact pads of the electronic module 30 and the mating portions 38 and 138 cause the intermediate portions 92 and 192 to deflect in the directions $D_2$ and $D_1$, respectively. Because each of the electrical contacts 34 and 36 electrically shorts against itself via engagement with the housing body 14 instead of engagement with the electronic module 30, each of the electrical contacts 34 and 36 is "pre-shorted" before insertion of the mating edge portion 28 of the electronic module 30 into the slot 26.

When the electrical contacts 34 and 36 are received within the corresponding openings 32, the end portions 98 and 198 are received within the corresponding recess 308 and the extensions 106 or 206 engage the side walls 300 and 302 to facilitate retaining the electrical contact 34 or 36 in position within the opening 32 using an interference-fit arrangement. Optionally, the projections 108 and 208 (FIG. 3) of the extensions 106 and 206 may engage the side walls 302 and 304 to facilitate retaining the corresponding electrical contact 34 or 36 using an interference-fit arrangement.

Figure 7:
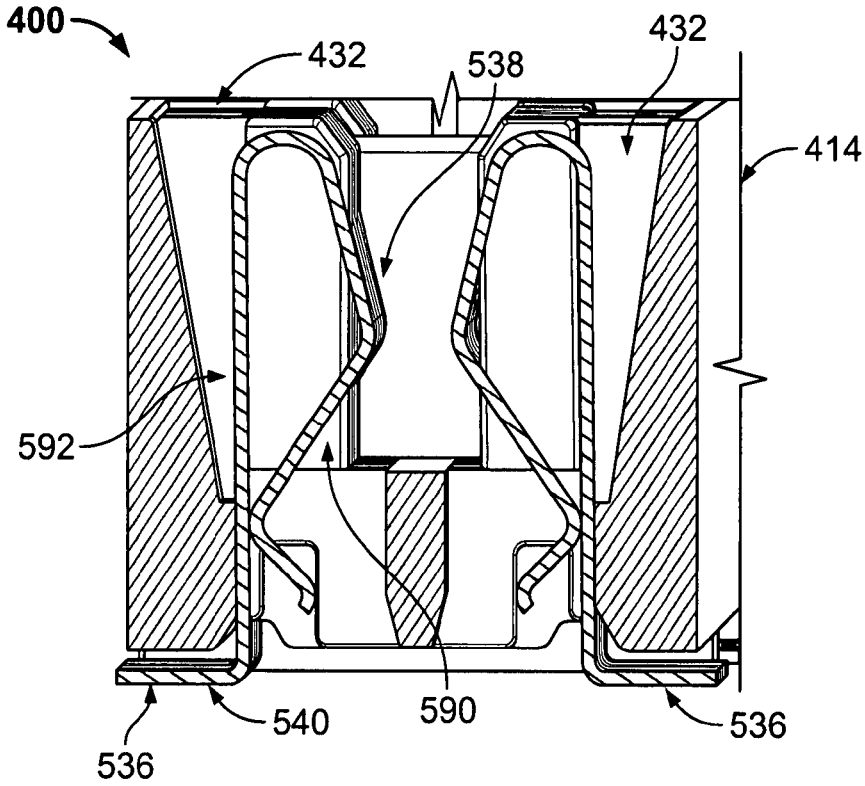
FIG. 7 is a perspective view of a cross-section of an exemplary alternative embodiment of a socket connector assembly.

In the exemplary embodiment of FIGS. 1-6, the mounting contact portions 40 and 140 of the electrical contacts 34 and 36, respectively, are configured as solder tails that electrically connect to the circuit board 42 using solder. However, the mounting contact portions 40 and 140 are not limited to being solder tails, but rather may have any suitable arrangement, configuration, structure, geometry, and/or the like that enables the mounting contact portions 40 and 140 to electrically connected to the circuit board 42 and/or another electrical component, such as, but not limited to, using a press-fit arrangement and/or a surface mount arrangement. For example, FIG. 7 is a perspective view of a cross-section of an exemplary alternative embodiment of a socket connector assembly 400. The socket connector assembly 400 includes a plurality of electrical contacts 536 each held within a corresponding opening 432 within a housing body 414. Each of the electrical contacts 536 includes a mating contact portion 538, a mounting contact portion 540, a spring portion 590, and an intermediate portion 592. Each of the mounting contact portions 540 of the electrical contacts 536 is configured to electrically connect to a circuit board or other electrical component using a surface mount arrangement.

Figure 8:
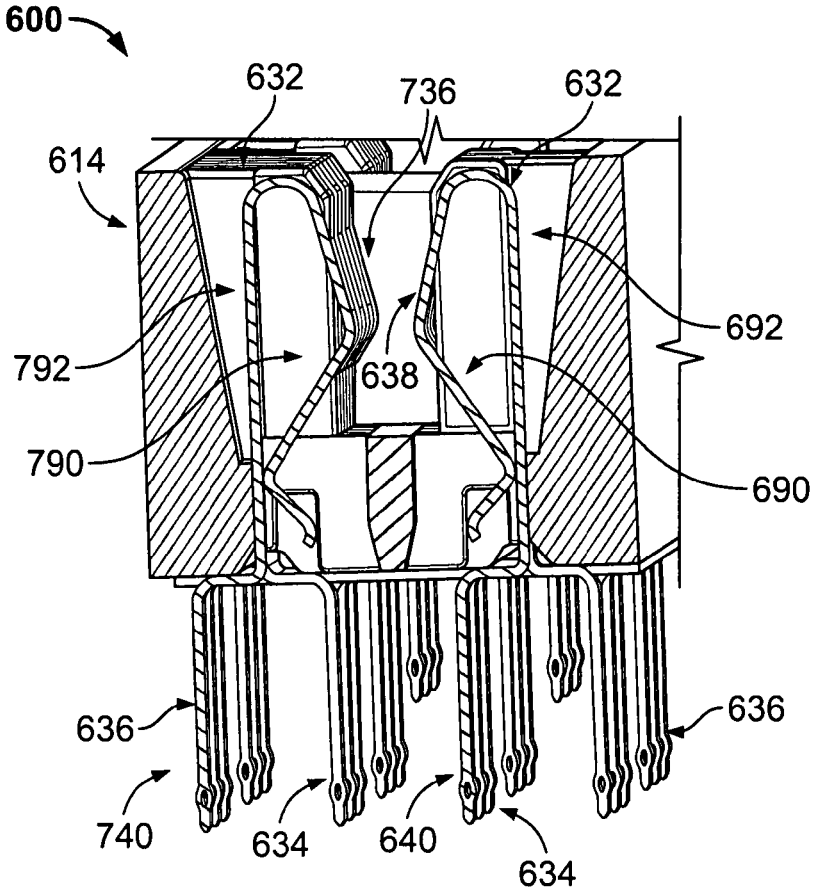
FIG. 8 is a perspective view of a cross-section of another exemplary alternative embodiment of a socket connector assembly.

FIG. 8 is a perspective view of a cross-section of another exemplary alternative embodiment of a socket connector assembly 600. The socket connector assembly 600 includes a plurality of inner and outer electrical contacts 634 and 636, respectively, each held within a corresponding opening 632 within a housing body 614. The electrical contacts 634 and 636 each include a respective mating contact portion 638 and 738, mounting contact portion 640 and 740, spring portion 690 and 790, and intermediate portion 692 and 792. Each of the mounting contact portions 640 and 740 is configured as to electrically connect to a circuit board or other electrical component using a press-fit arrangement.

The embodiments described and illustrated herein provide a lower profile socket connector that may be suitable for use in limited space applications. The connector meets ATCA height restrictions. The connector includes a contact designed to be engaged by the housing body to electrically short against itself to accommodate a lower profile housing for ATCA as well as other low profile applications.

The connector embodiments described and/or illustrated are not limited to use with any exemplary type of electronic module described and/or illustrated herein, but rather may be used with any suitable type of electronic module, such as, but not limited to, processor modules and/or memory modules, such as, but not limited to, Dynamic Random Access Memory (DRAM), Synchronous Dynamic Random Access Memory (SDRAM), Extended Data Out Random Access Memory (EDO RAM), Single In-line Memory Modules (SIMM's), Dual In-line Memory Modules (DIMM's), Small Outline DIMM's (SODIMM's), Fully Buffered DIMM's, and/or the like. Although described and illustrated herein as a socket connector, the embodiments described and/or illustrated herein are not limited to socket connectors, but rather may be any suitable type of connector, such as, but not limited to, a plug connector and/or a surface connector.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. For example, although specific sensor elements are described and/or illustrated with specific attachment devices, each described and/or illustrated sensor element may be used with any of the described and/or illustrated attachment devices as is appropriate. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical connector assembly comprising:

a housing comprising a body fabricated at least partially from a dielectric material, the housing body having an opening therein; and an electrical contact held by the housing, the electrical contact comprising an intermediate portion and a spring portion each held at least partially within the opening, the spring portion of the electrical contact being engaged by the housing body such that the housing body deflects the spring portion into shorting engagement with the intermediate portion of the electrical contact.

2. The electrical connector assembly according to claim 1, wherein the housing body comprises a shoulder, the opening communicating with the shoulder, the spring portion of the electrical contact engaging the shoulder such that the spring portion is deflected into shorting engagement with the intermediate portion of the electrical contact.

3. The electrical connector assembly according to claim 1, wherein the housing body comprises a shoulder, the opening communicating with the shoulder, the spring portion of electrical contact comprising an extension that engages the shoulder such that the spring portion is deflected into shorting engagement with the intermediate portion of the electrical contact.

4. The electrical connector assembly according to claim 1, wherein the spring portion of the electrical contact comprises a stem having a side surface and an extension extending outwardly from the side surface, the extension being engaged by the housing body such that the housing body deflects the spring portion into shorting engagement with the intermediate portion of the electrical contact.

5. The electrical connector assembly according to claim 1, wherein the intermediate portion of the electrical contact extends between mating and mounting contact portions of the electrical contact, the mating contact portion being configured to electrically connect to a first electrical component and the mounting contact portion being configured to electrically connect to a second electrical component.

6. The electrical connector assembly according to claim 1, wherein the electrical contact includes mating and mounting contact portions of the electrical contact, the mating contact portion being configured to electrically connect to a first electrical component and the mounting contact portion being configured to electrically connect to a second electrical component, the spring portion of the electrical contact comprising the mating contact portion.

7. The electrical connector assembly according to claim 1, wherein the spring portion of the electrical contact comprises an end portion of the electrical contact.

8. The electrical connector assembly according to claim 1, wherein the electrical contact includes a mounting contact portion configured to electrically connect to an electrical component using at least one of a press-fit arrangement, a surface mount arrangement, and a solder tail arrangement.

9. The electrical connector assembly according to claim 1, wherein the intermediate portion of the electrical contact comprises an extension that engages the housing body to facilitate at least one of preventing and reducing movement of the intermediate portion when the spring portion is deflected into shorting engagement with the intermediate portion.

10. The electrical connector assembly according to claim 1, wherein the spring portion of the electrical contact comprises an end portion of the electrical contact, the end portion being engaged by the housing body such that the housing body deflects the spring portion into shorting engagement with the intermediate portion.

11. A socket connector assembly for connecting a module card to a circuit board, said socket connector comprising:

a housing having a body extending along a longitudinal axis between opposite ends, the housing body including a mounting face configured for mounting on the circuit board and a slot configured to receive a mating edge of the module card, the housing body having a plurality of openings therein; and a plurality of electrical contacts held by the housing, each electrical contact comprising an intermediate portion and a spring portion each held at least partially within the corresponding opening, the spring portion of each of the electrical contacts being engaged by the housing body such that the housing body deflects the spring portion into shorting engagement with the intermediate portion of the same electrical contact.

12. The socket connector assembly according to claim 11, wherein the housing body comprises a plurality of shoulders, each opening communicating with at least one corresponding shoulder, the spring portion of each of the electrical contacts engaging at least one corresponding shoulder such that the spring portion is deflected into shorting engagement with the intermediate portion of the same electrical contact.

13. The socket connector assembly according to claim 11, wherein the housing body comprises a plurality of shoulders, each opening communicating with at least one corresponding shoulder, the spring portion of each of the electrical contacts comprising an extension that engages at least one corresponding shoulder such that the spring portion is deflected into shorting engagement with the intermediate portion of the same electrical contact.

14. The socket connector assembly according to claim 11, wherein the spring portion of at least one of the electrical contacts comprises a stem having a side surface and an extension extending outwardly from the side surface, the extension being engaged by the housing body such that the housing body deflects the spring portion into shorting engagement with the intermediate portion of the same electrical contact.

15. The socket connector assembly according to claim 11, wherein the intermediate portion of each electrical contact extends between mating and mounting contact portions of the electrical contact, the mating contact portion being configured to electrically connect to the module card and the mounting contact portion being configured to electrically connect to the circuit board.

16. The socket connector assembly according to claim 11, wherein each electrical contact includes mating and mounting contact portions of the electrical contact, the mating contact portion being configured to electrically connect to the module card and the mounting contact portion being configured to electrically connect to the circuit board, the spring portion of each electrical contact comprising the mating contact portion of the electrical contact.

17. The socket connector assembly according to claim 11, wherein the spring portion of at least one of the electrical contacts comprises an end portion of the electrical contact, the end portion being engaged by the housing body such that the housing body deflects the spring portion into shorting engagement with the intermediate portion of the same electrical contact.

18. The socket connector assembly according to claim 11, wherein each electrical contact includes a mounting contact portion configured to electrically connect to the circuit board using at least one of a press-fit arrangement, a surface mount arrangement, and a solder tail arrangement.

19. The socket connector assembly according to claim 11, wherein the intermediate portion of each electrical contact comprises an extension that engages the housing body to facilitate at least one of preventing and reducing movement of the intermediate portion when the spring portion is deflected into shorting engagement with the intermediate portion.

20. A socket connector assembly for connecting a module card to a circuit board, said socket connector comprising:

a housing extending along a longitudinal axis between opposite ends, the housing including a mounting face configured for mounting on the circuit board and a slot configured to receive a mating edge of the module card, the housing having an opening therein; and an electrical contact held by the housing, the electrical contact comprising an intermediate portion and a spring portion each held at least partially within the opening, the housing deflecting the spring portion of the electrical contact from a non-shorting position to a shorting position wherein the spring portion of the electrical contact is in shorting engagement with the intermediate portion of the electrical contact, the spring portion of the electrical contact being in shorting engagement with the intermediate portion of the electrical contact before the mating edge of the module card is inserted within the slot.

* * * * *